US011046480B2

(12) United States Patent
McCrea et al.

(10) Patent No.: US 11,046,480 B2
(45) Date of Patent: Jun. 29, 2021

(54) COLLAPSIBLE TOOLBOX

(71) Applicant: JMC Engineering, LLC, San Carlos, CA (US)

(72) Inventors: James Anthony McCrea, San Carlos, CA (US); Frank Clark, Pasadena, CA (US)

(73) Assignee: JMC Engineering, LLC, San Carlos, CA (US)

( * ) Notice: Subject to any disclaimer, the term of this patent is extended or adjusted under 35 U.S.C. 154(b) by 97 days.

(21) Appl. No.: 16/252,583

(22) Filed: Jan. 19, 2019

(65) Prior Publication Data

US 2019/0225374 A1 Jul. 25, 2019

Related U.S. Application Data

(60) Provisional application No. 62/620,104, filed on Jan. 22, 2018.

(51) Int. Cl.
*B65D 21/08* (2006.01)
*B25H 3/02* (2006.01)

(52) U.S. Cl.
CPC ..... *B65D 21/086* (2013.01); *B25H 3/02* (2013.01); *B65D 21/083* (2013.01)

(58) Field of Classification Search
CPC ..... B65D 21/086; B65D 21/083; B65D 7/28; B65D 9/18; B65D 88/005; B65D 88/526; B65D 88/528; B65D 88/52; B65D 1/225; B65D 11/1893; B65D 11/1866; B65D 2519/00582; B65D 7/30; B65D 11/1873; B65D 11/18; B65D 81/361; B25H 3/021
USPC ..... 220/4.28, 4.29, 4.32, 4.33; 206/577, 600
See application file for complete search history.

(56) References Cited

U.S. PATENT DOCUMENTS 3,101,226 A * 8/1963 Cochran, Jr. ..... B65D 7/24 312/265.5
3,497,127 A * 2/1970 Box ..... B65D 1/225 220/7
3,984,023 A * 10/1976 Hodas ..... B65D 11/1873 220/4.28
4,102,557 A * 7/1978 Lee ..... F16B 12/30 312/257.1
6,386,383 B1 * 5/2002 Roudonis ..... B65D 88/522 220/1.5
6,598,756 B1 * 7/2003 Rosenfeldt ..... B65D 88/526 220/4.28
7,044,326 B2 * 5/2006 Martin ..... B65D 7/06 220/676

(Continued)

*Primary Examiner* — Robert Poon
(74) *Attorney, Agent, or Firm* — Keith Kline; The Kline Law Firm PC

(57) ABSTRACT

This disclosure relates to portable storage boxes, also called job boxes, that may be adapted for use on construction sites. Existing boxes are typically too large and heavy to move by just one person without additional equipment. Existing storage boxes are difficult to maneuver in tight spaces. This invention allows a job box to be broken down into three sub-assemblies of roughly equal size. The individual sub-assemblies are easier to carry since they are compact and can be held close to the body when the user is in a standing position. The individual sub-assemblies stack well against each other allowing the storage box to be stored and transported in a more space efficient way than present art unitary assembly storage boxes.

6 Claims, 10 Drawing Sheets

(56) References Cited

U.S. PATENT DOCUMENTS

| | | | | |
|---|---|---|---|---|
| 8,608,003 | B2 * | 12/2013 | Uno | B65D 19/18 206/206 |
| 2002/0104839 | A1 * | 8/2002 | Hsiao | A47F 3/005 220/4.28 |
| 2004/0173610 | A1 * | 9/2004 | Gregorio Gracia | B65D 11/1873 220/4.28 |
| 2017/0073109 | A1 * | 3/2017 | Zhang | B65D 21/083 |
| 2018/0186511 | A1 * | 7/2018 | Sullivan | B65D 21/083 |
| 2018/0327138 | A1 * | 11/2018 | Englert | B65D 11/18 |

* cited by examiner

DETAIL B

SECTION A-A

SECTION A-A

SECTION C-C

DETAIL B
SCALE 1 : 2

DETAIL F

DETAIL G

SECTION E-E

SECTION D-D

SECTION A-A

SECTION D-D

SECTION A-A

DETAIL C

DETAIL B

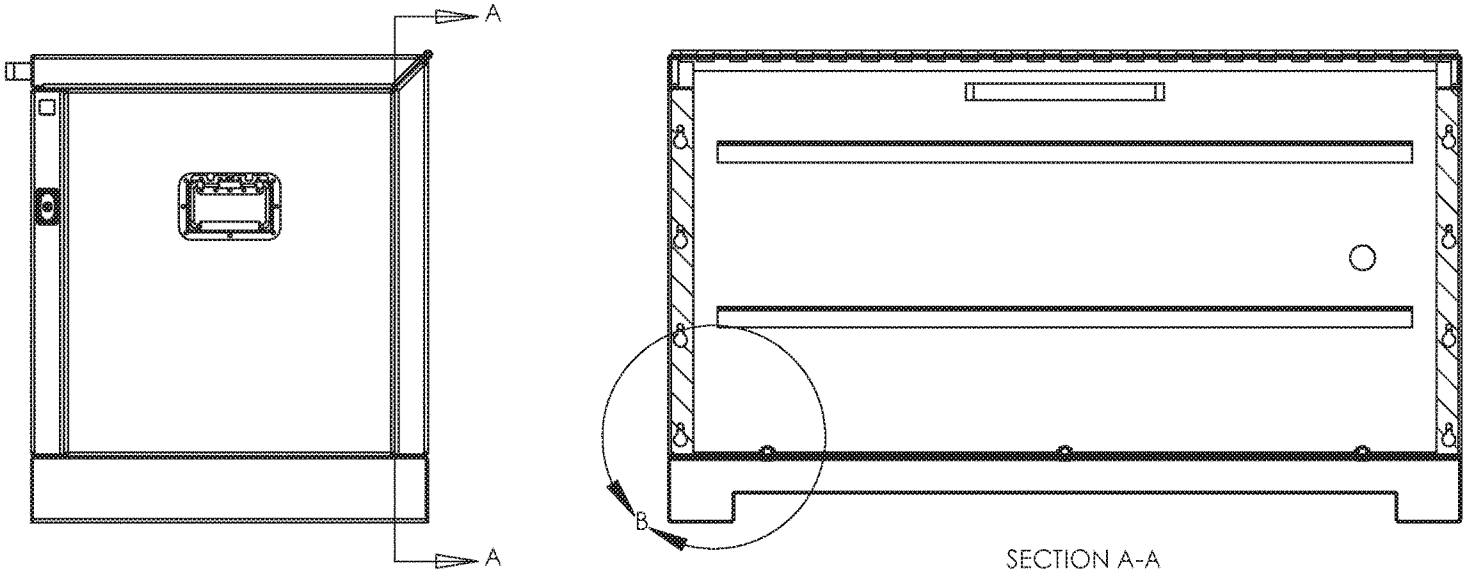
FIG. 7A
SECTION A-A
FIG. 7B
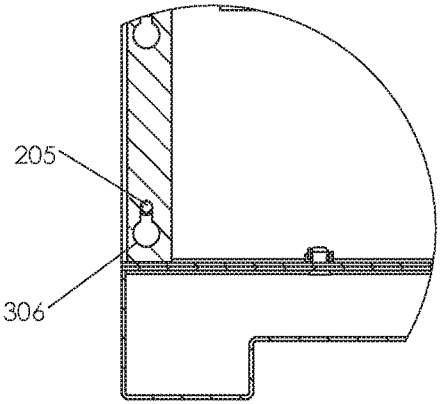
DETAIL B
FIG. 7C

COLLAPSIBLE TOOLBOX

CROSS REFERENCE TO RELATED APPLICATIONS

This application claims the priority benefit of U.S. Provisional Application No. 62/620,104, filed on Jan. 22, 2018, which is hereby incorporated herein by reference in its entirety, including all references and appendices cited therein, for all purposes.

FIELD OF THE INVENTION

The invention pertains generally to storage devices, and more particularly is a collapsible job box adapted to hold tools as, for example, on a construction site.

SUMMARY

The invention disclosed is a collapsible storage box adapted to be used for the storage of tools and equipment. The job box can be easily disassembled into 3 sub-assemblies of roughly equal size for more efficient transportation and storage of the box.

The base is one of the three sub-assemblies. The thickness of the base is approximately double that of the other sides to insure strength and durability and allow transportation of the storage box by forklift if desired.

The front and sides of the box comprise a second sub-assembly. In some embodiments, the front and sides of the storage box are secured to the base by way of posts and cross pins. When disassembled, the sides hinge such that they collapse against the front.

The top and back of the box may constitute a third sub-assembly and are attached last during assembly of the box.

The back has features which lock into the sides when the back is slid vertically into place. The back is then secured to the base by way of posts and cross pins. A hinge between the top and back allows the top to hinge backwards such that the external portion of the top meets the external portion of the back. This creates a profile for the top and back of the disassembled box that is similar to the base and to the front and sides sub-assemblies so that transportation and storage are facilitated. Carry handles 105 are located on each sub-assembly to assist in lifting and carrying the sub-assemblies.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

FIGS. 7A-C show the assembled toolbox with detail views of the keyhole slot retention mechanism between the sides and rear.

DETAILED DESCRIPTION

Figure 1B:
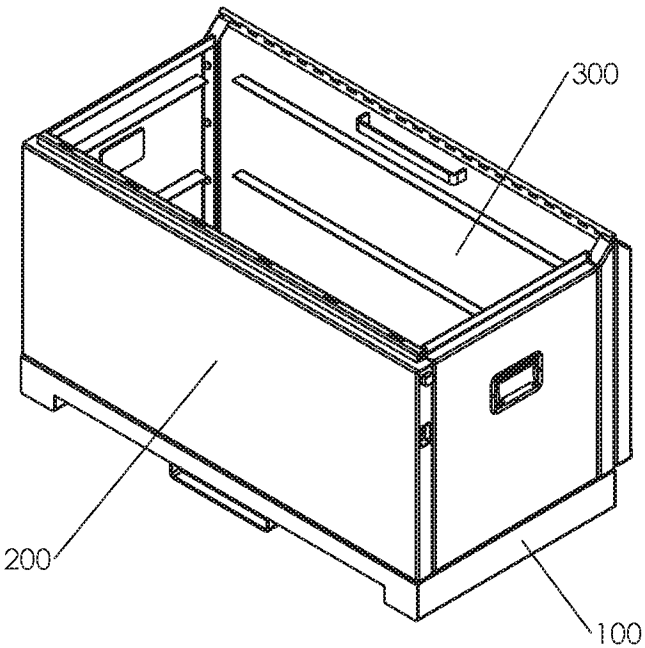
FIG. 1B shows the assembled toolbox in an open configuration.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

Figure 1A:
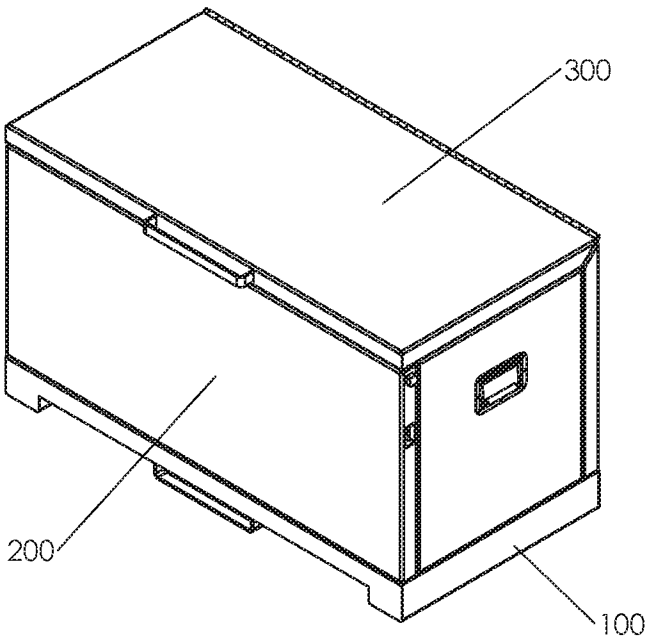
FIG. 1A shows the assembled toolbox in a closed configuration.
Figure 2B:
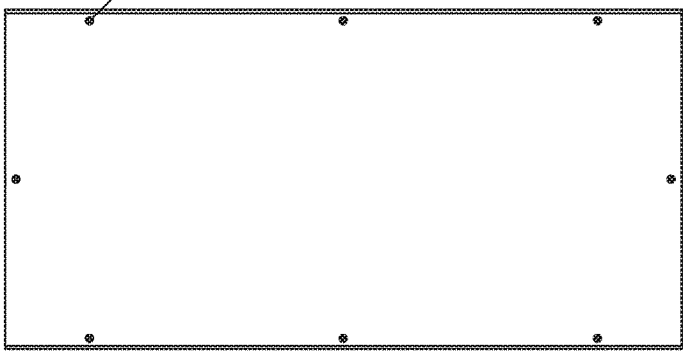
FIGS. 2A-2E show the base sub-assembly.
Figure 2C:
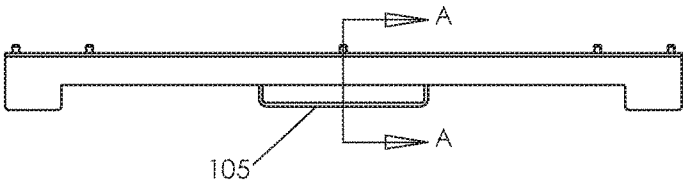
Figure 2A:
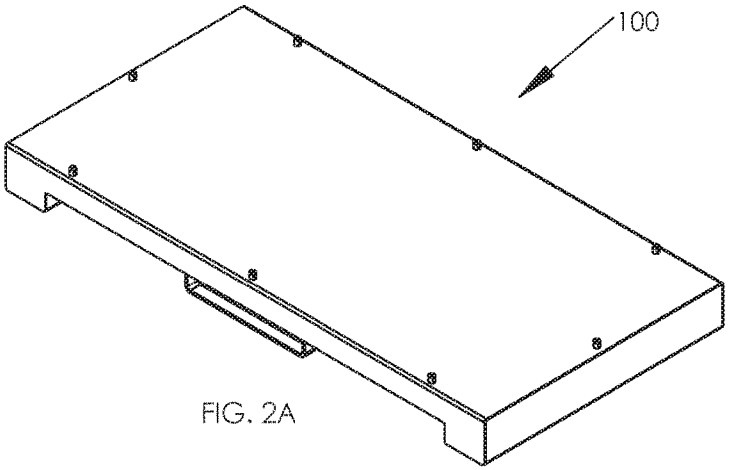
Figure 2E:
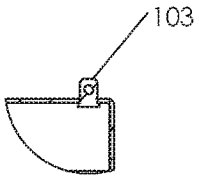
Figure 2D:
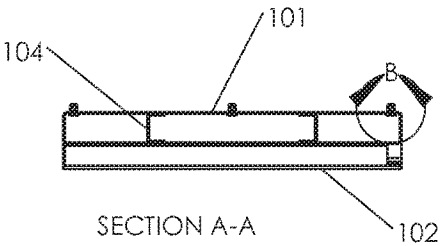

FIG. 1A shows the toolbox assembled and closed with base 100, front/sides sub-assembly 200, and top/back sub-assembly 300. FIG. 1B shows the toolbox assembled and fully open. A securing mechanism such as a cord can be employed to hold the top in a desired position if the toolbox is to be other than fully opened.

Figure 6A:
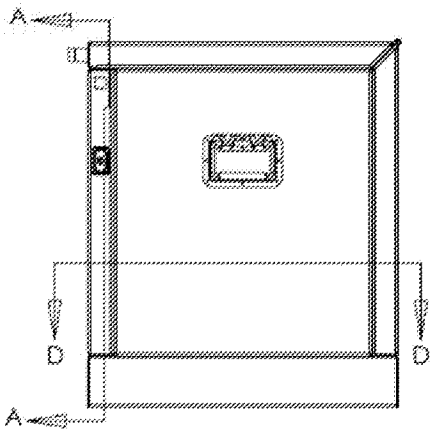
FIGS. 6A-E show the assembled toolbox with detail views of the locking mechanism between the top and front as well as the cross-pin retention mechanism between the front, sides, back, and base.
Figure 6E:
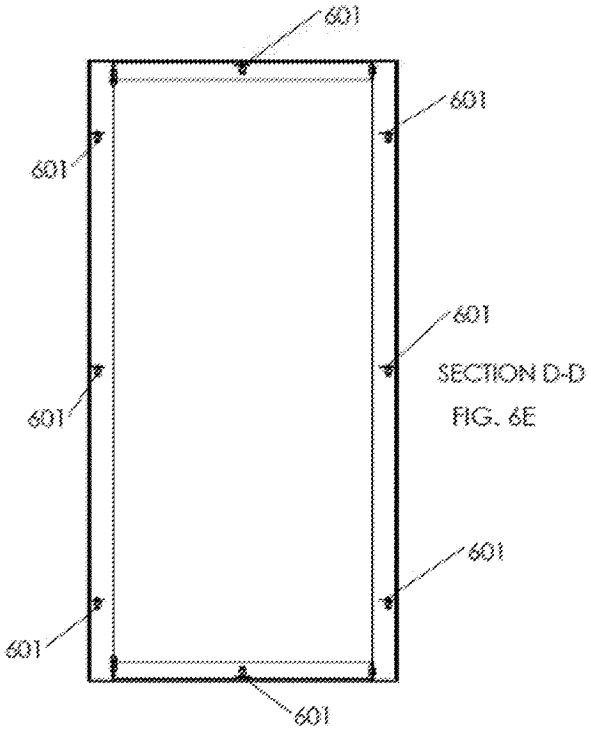
Figure 6B:
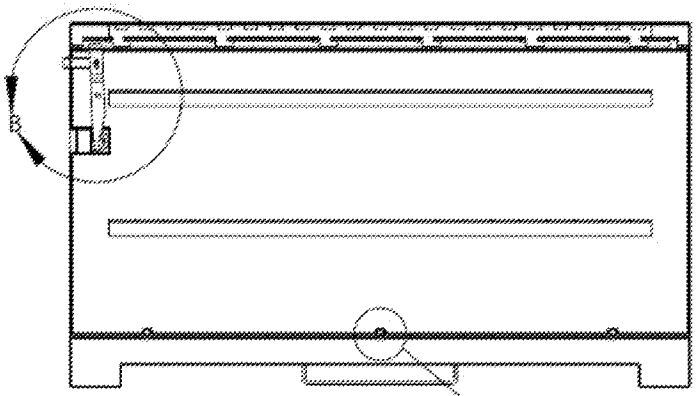
Figure 6D:
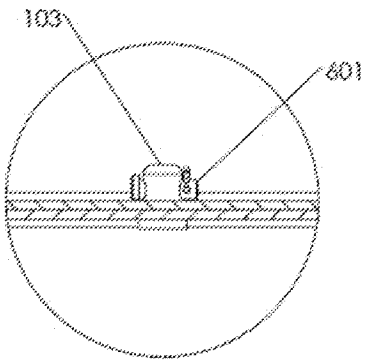
Figure 6C:
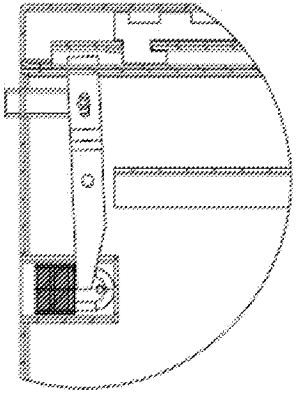

FIGS. 2A-E show the base 100 with the top surface 101 of the base 100 attached to the bottom surface 102 of the base 100. Cross braces 104 may be utilized to add extra internal support. Posts 103 have holes for receiving a cross pin (described in further detail with reference to FIG. 6D) to fix the front/sides 200 and top/back sub-assemblies to the base 100.

FIGS. 3A-F show the front/side sub-assembly 200. In some embodiments, the front 201 is attached to a first side 202 and a second side 203 with hinges 204 and 204' respectively. Headed posts 205 (see FIG. 3F) are secured to the back edge of sides 202, 203, and may be used to connect and affix the sides 202, 203 to the back 301. A plurality of holes 215 on lower edges of both the front 201 and sides 202, 203 receive posts 103 from base 100 to secure the front 201 and the sides 202, 203 to the base 100. One or more cross braces 207, 207' may be employed to provide additional support. Handles 206 can be affixed to each sub-assembly of the storage box device to facilitate lifting of the sub-assemblies when the device is disassembled.

FIGS. 3G-H and 3J-L and 3N show the front/side sub-assembly 200 with locking mechanism including lock 214, actuation bar 210 pivoting on pin 211 and actuating slider 208. In most embodiments, the locking mechanism will be situated on the right corner of the front/side sub-assembly 200. Cross pin 213 retains a lock 214 (supplied by the user) in chamber 212. When the lock 214 is unlocked by the user, release lever 209 can be actuated to release the locking mechanism so that the storage box can be opened.

Figure 3A:
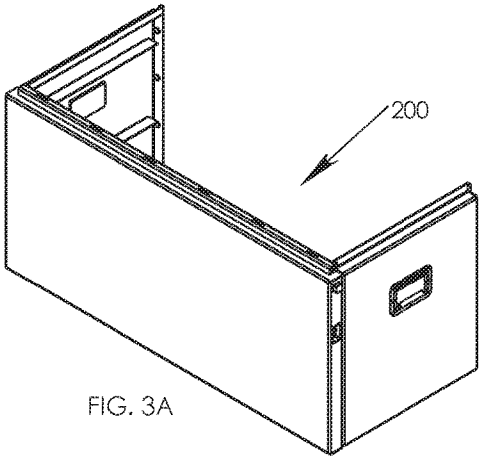
FIGS. 3A-H and 3J-L and N show the front/sides sub-assembly.
Figure 3B:
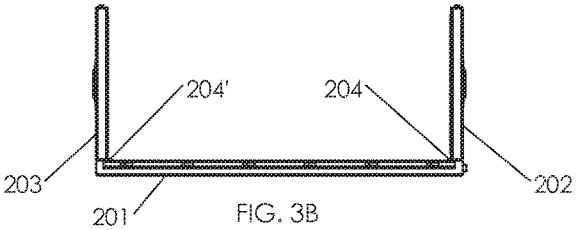
Figure 3C:
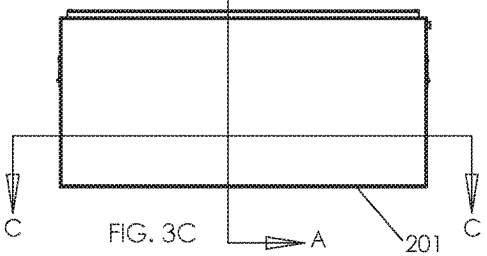
Figure 3D:
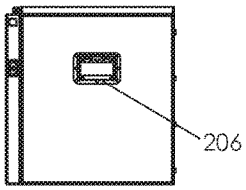
Figure 3E:
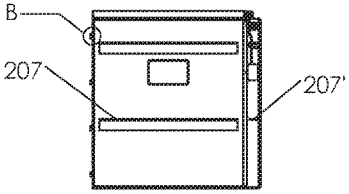
Figure 3G:
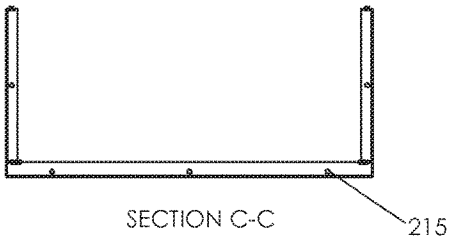
Figure 3F:
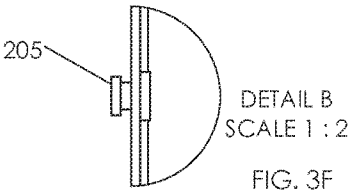
Figure 3K:
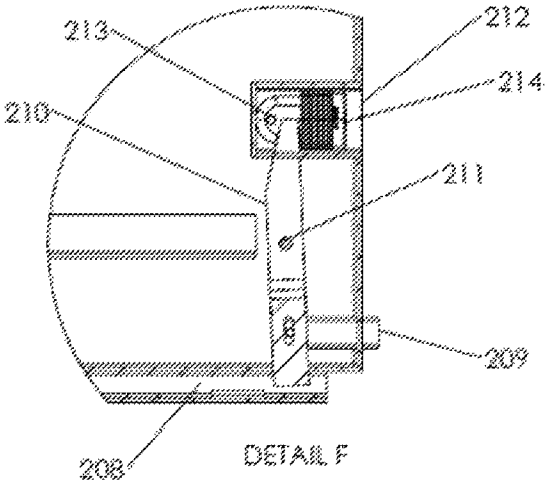
Figure 3L:
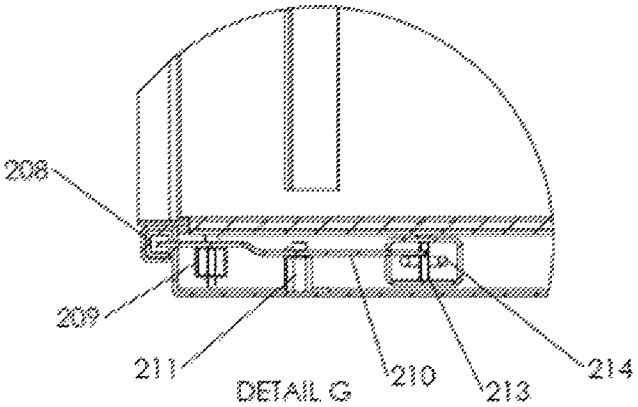
Figure 3J:
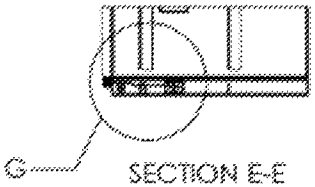
Figure 3H:
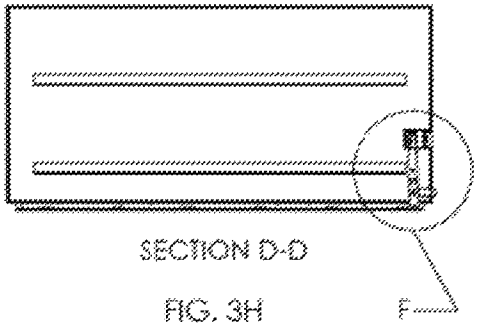
Figure 3N:
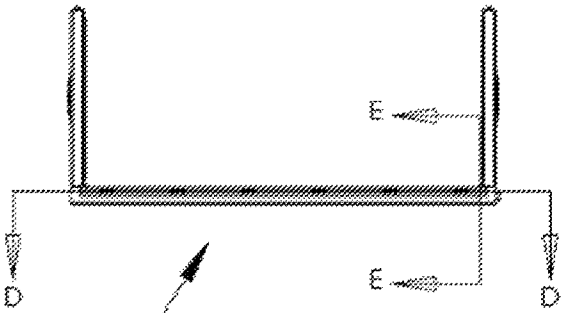
Figure 3M:
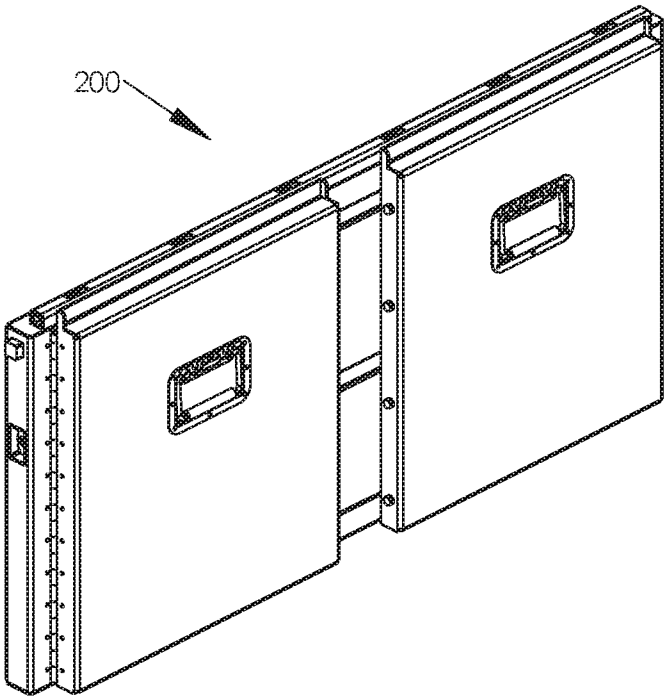

FIG. 3M shows the front/side sub-assembly 200 in a collapsed configuration with the sides folded in against the top for storage and transportation of the front/side sub-assembly 200.

FIGS. 4A-E show the top/back sub-assembly 300 with the top 302 hinged to the back 301 with hinge 303. Keyhole features 306 engage with headed posts 205 to secure the back 301 to the sides 202, 203. Holes 307 engage with posts 103 to secure the back 301 to the base 100 with cross pins. Catch bar 304 engages with actuating slider 208 to lock the box closed. Handle 305 can be used to open the top 302 of the storage box for access to the contents.

Figure 4E:
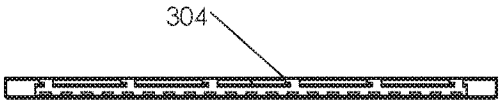
FIGS. 4A-4F show the top/back sub-assembly.
Figure 4B:
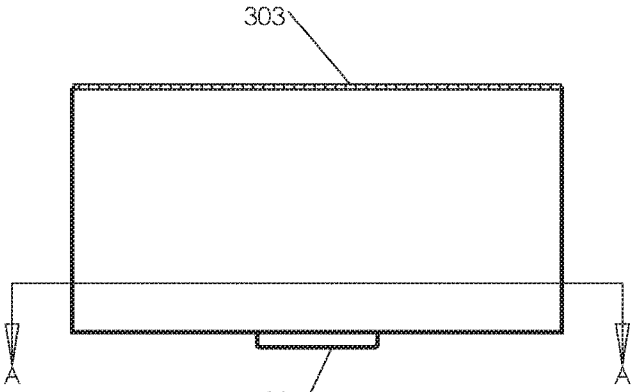
Figure 4C:
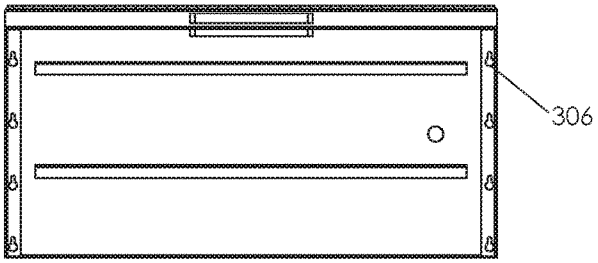
Figure 4A:
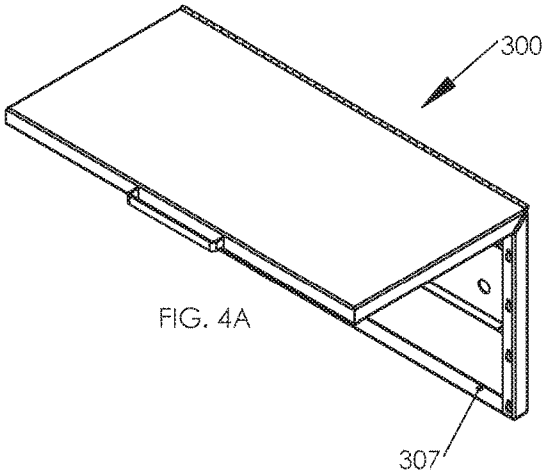
Figure 4D:
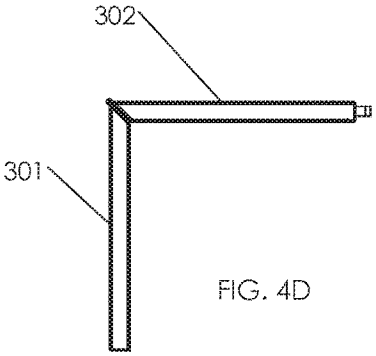
Figure 4F:
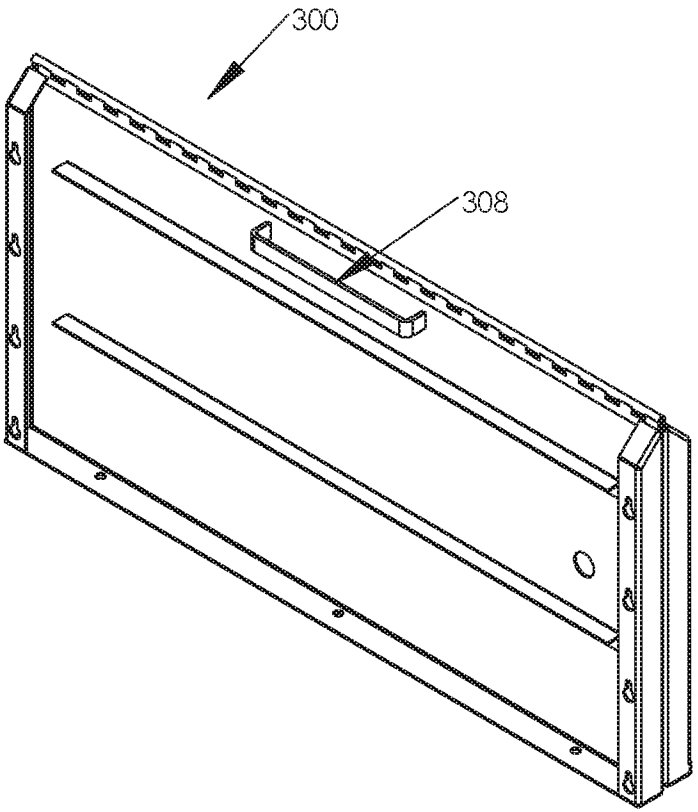

FIG. 4F shows the top/back sub-assembly 300 in the collapsed configuration for storage and transportation. Handle 308 can be used to facilitate lifting and transport of the storage box in the collapsed configuration.

Figure 5A:
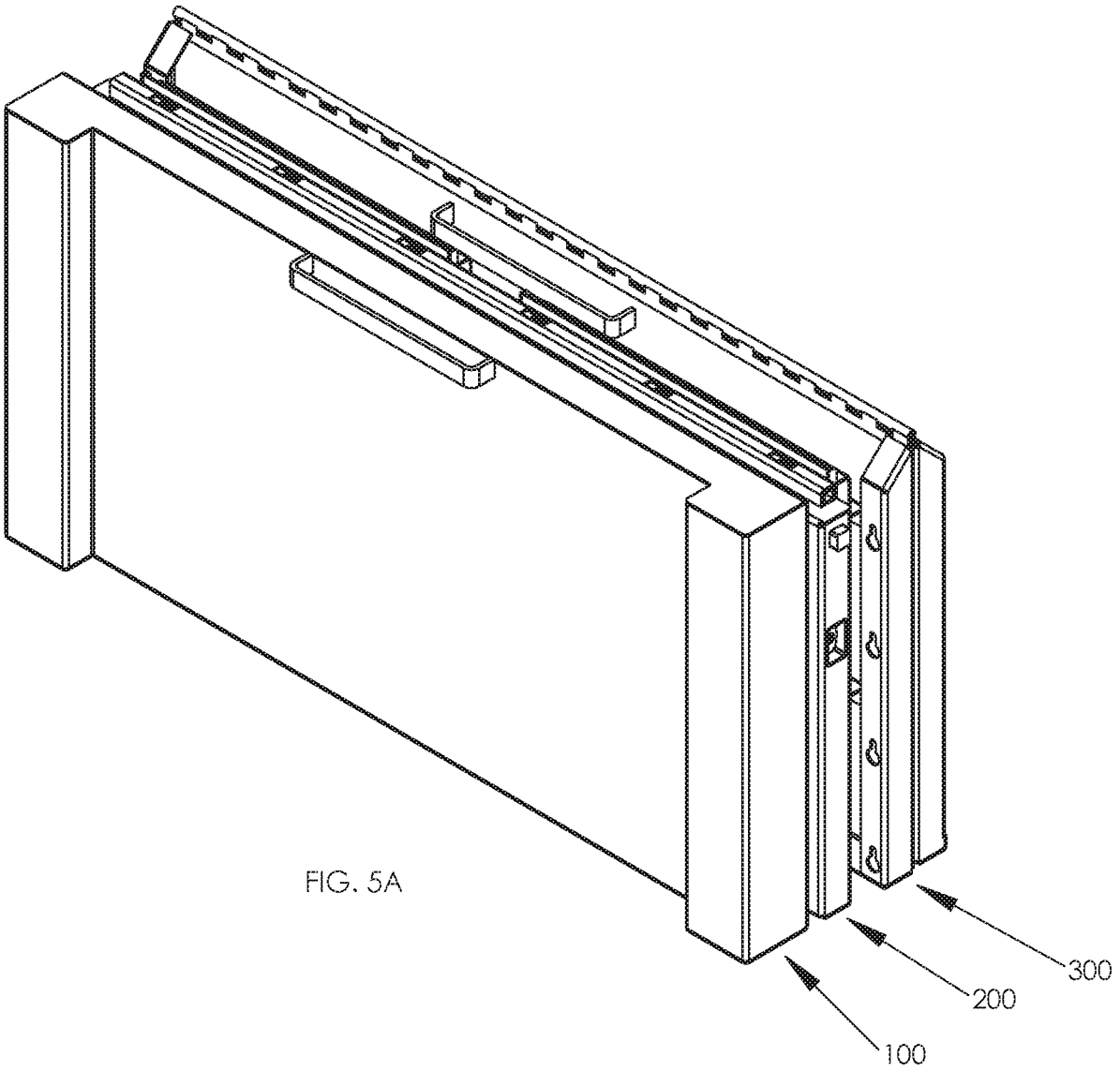
FIG. 5A shows the base, front/sides, and top/back sub-assemblies in a collapsed and stacked configuration

FIG. 5A shows all 3 sub-assemblies 100, 200, and 300 in the collapsed and stacked configuration, illustrating the space savings made possible by the storage box.

FIGS. 6A-E show additional details of the locking mechanism and cross pins 601 installed in holes of posts 103 in base 100 that are used to retain the front 201, sides 202, 203, and back 301 to the base 100. Cross pins 601 can be secured in the posts 103 with a clevis pin or the like inserted into a hole in the cross pin 601.

FIGS. 7A-C show detail of the engagement between the headed posts 205 in the sides 202, 203 and the keyhole features 306 in the back 301. The headed posts 205 can engage the keyholes 306 when the back 301 is brought down over posts 103 in base 100 so that the sub-assemblies 100, 200, and 300 are releasably attached to each other.

While specific embodiments of, and examples for, the system are described above for illustrative purposes, various equivalent modifications are possible within the scope of the system, as those skilled in the relevant art will recognize. For example, while processes or steps are presented in a given order, alternative embodiments may perform routines having steps in a different order, and some processes or steps may be deleted, moved, added, subdivided, combined, and/or modified to provide alternative or sub-combinations. Each of these processes or steps may be implemented in a variety of different ways. Also, while processes or steps are at times shown as being performed in series, these processes or steps may instead be performed in parallel, or may be performed at different times.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A collapsible storage box, comprising:

a first sub-assembly, a second sub-assembly, and a third sub-assembly, the sub-assemblies being releasably attached to each other to form the collapsible storage box; wherein the first, second and third sub-assemblies have approximately equal footprints when collapsed;

the first sub-assembly comprises a base of the collapsible storage box;

the second sub-assembly comprises a front and sides of the collapsible storage box, the sides including a first side and a second side, the first side being attached to the front with a first hinge and the second side being attached to the front with a second hinge, each of the front and the sides having an interior face and an exterior face, wherein, when the second sub-assembly is collapsed, the sides lying flush with the front such that the interior face of each of the sides directly contacts the interior face of the front;

the third sub-assembly comprises a top and a back of the collapsible storage box, the top being attached to the back with a second hinge; and the collapsible storage box includes a locking mechanism so that contents of the box are secured when the top of the collapsible storage box is closed.

2. The storage box of claim 1, wherein:

the locking mechanism comprises a lock, an actuation bar that pivots on a pin, and an actuating slider that engages and disengages the locking mechanism.

3. The storage box of claim 2, wherein:

when the lock is removed from a receiving compartment, a release lever is actuated so that the locking mechanism moves from a locked position to an open position so that the storage box can be opened.

4. The storage box of claim 1, wherein:

the first, second, and third sub-assemblies are joined together by a mechanism that does not require any tools to disassemble the sub-assemblies from each other.

5. The storage box of claim 1, wherein:

the base of the storage box is approximately twice as thick as the sides and top of the storage box.

6. The storage box of claim 1, wherein:

at least one of the sub-assemblies includes a handle to facilitate lifting and carrying of the at least one sub-assembly.

* * * * *